US007745087B2

(12) United States Patent
Tsurumi et al.

(10) Patent No.: US 7,745,087 B2
(45) Date of Patent: Jun. 29, 2010

(54) ELECTROSTATIC IMAGE DEVELOPER, PROCESS CARTRIDGE, AND IMAGE FORMING APPARATUS

(75) Inventors: Yosuke Tsurumi, Kanagawa (JP); Akihiro Iizuka, Kanagawa (JP); Tsuyoshi Murakami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 282 days.

(21) Appl. No.: 11/905,283

(22) Filed: Sep. 28, 2007

(65) Prior Publication Data

US 2008/0199799 A1 Aug. 21, 2008

(30) Foreign Application Priority Data

Feb. 21, 2007 (JP) ..... 2007-040835

(51) Int. Cl.
*G03G 9/093* (2006.01)

(52) U.S. Cl. ..... 430/110.2; 399/267

(58) Field of Classification Search ..... 430/110.2; 399/267

See application file for complete search history.

(56) References Cited

U.S. PATENT DOCUMENTS

2005/0214671 A1* 9/2005 Mizutani et al. ..... 430/111.35
2007/0172748 A1* 7/2007 Inoue et al. ..... 430/45.56

FOREIGN PATENT DOCUMENTS

JP A-07-077826 3/1995
JP A-2001-051453 2/2001
JP A-2006-011290 1/2006

* cited by examiner

*Primary Examiner*—John L Goodrow
(74) *Attorney, Agent, or Firm*—Oliff & Berridge, PLC

(57) ABSTRACT

An electrostatic image developer contains a toner and a carrier having a resin coating layer formed on the surface of a core material containing a ferrite component, wherein a ratio R1/R2 is from 0.88 to 0.92 where R1 is the resistance value (Ω) of the developer having a toner concentration of 2 mass % in a state formed into a magnetic brush, at an applied voltage of $10^4$ V/cm, and R2 is the resistance value (Ω) of the developer having a toner concentration of 12 mass % in a state formed into a magnetic brush, at an applied voltage of $10^4$ V/cm.

18 Claims, 2 Drawing Sheets

ELECTROSTATIC IMAGE DEVELOPER, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2007-40835, filed Feb. 21, 2007.

BACKGROUND

1. Technical Field

The invention relates to an electrostatic image developer, a process cartridge, and an image forming apparatus.

2. Related Art

In electrophotography, an electrostatic latent image is formed on an image supporting member (photoreceptor) though a charging step and a light exposure step, then the electrostatic latent image is developed with a toner, and the developed image is transferred onto a transfer material and fixed on the transfer material by heating or the like to obtain an image. Developers used in electrophotography can be broadly classified as one-component developers using only a toner having a colorant dispersed in a binder resin and two-component developers consisting of the above toner and a carrier. In a two-component developer, the carrier has functions such as stirring, transportation and charging and has separate its functions from those of the developer, thus attaining features such as excellent controllability and, therefore, two-component developers are widely used at present.

In recent years, digitalization processing has come to be used as a method that achieves high image quality, and by this digitalization processing, high-speed processing of complicated images has been made feasible. In a process of forming an electrostatic latent image on an image supporting member, a laser beam is used as an exposure light source, and the development of exposure technology with a small laser beam has enabled achievement of finer electrostatic latent images. By such image processing technology, electrophotography is extending to light printing and the like. In recent electrophotographic devices, higher speed and downsizing are required. Particularly with respect to full-color image quality, high resolution and high quality of a similar level to high-quality printing and silver halide photography are required. Consequently, it is important to maintain the electrification of a toner in the developer in order to faithfully visualize a finer latent image. That is, further improvement of the charging maintenance of a carrier having a charging function is required.

Meanwhile, carrier resistance is also significant in terms of its influence on higher image quality. In recent digital equipment, the carrier has a smaller diameter and lower resistance in order to cope with higher image quality. By reducing the diameter of the carrier, a fine image can be reproduced, and stable charging can be imparted even to a small-diameter toner. By reducing the resistance, the reproducibility of a solid image is improved and, in particular, the carrier is suitable for full-color high-density images.

However, when the resistance of the carrier is reduced, there is the problem of easy carrier scattering.

Various research has been conducted with a view to reducing carrier scattering. For example, there has been a proposal to increase the resistance of a developer or carrier, but when a carrier of extremely high resistance is used, development is extremely susceptible to an edge effect whereby a toner is developed easily in a region toward the edge of a latent image forming a solid portion and, as a result, problem occur such as reduction in the density of a solid image. For the purpose of improving developability, a method of regulating the resistance of a magnetic brush to within a certain range has also been proposed, but a reduction in the resistance of a carrier occurs due to the abrasion and release of a resin layer of the carrier during long-term use and, as a result, the adhesion of the carrier to an image supporting member occurs. It can hardly be said, then, that a carrier of such high resistance has a sufficient performance in terms of reduction in the adhesion of the carrier to an image supporting member.

When used in an actual machine, the electrification of a toner tends to decrease, for example, in a high-temperature high-humidity environment, and thus fogging easily occurs at high toner concentration, whereas while the electrification of the toner is increased at low toner concentration, so that image density is stabilized without generating fogging, carrier scattering onto a photoreceptor easily occurs, which may result in image defects such as white spots or pollution in the background. In a low-temperature and low-humidity environment, the electrification of a toner tends to increase, and thus the charge of the toner is too high at low toner concentration thus destabilizing image density in some cases. Carrier scattering also easily occurs to cause image defects such as white spots or pollution in the background in some cases. At high toner concentration, on the other hand, there may easily occur image defects or the transfer of a carrier to a photoreceptor due to a charge injection from the tonier to the carrier.

In such cases, when a carrier having a flat resistive characteristic (that is, less change in resistance) with respect to changes in toner concentration is used, the charge of a toner from low to high toner concentrations is stabilized, and carrier scattering is suppressed, so the carrier is effective in respect of fogging, image density and carrier scattering. Even if the toner concentration is arbitrarily changed, the respective characteristics are stable and hardly influenced by the environment.

SUMMARY

According to an aspect of the invention, there is provided an electrostatic image developer including a toner and a carrier having a resin coating layer formed on the surface of a core material containing a ferrite component, wherein a ratio R1/R2 is from about 0.88 to about 0.92 where R1 is the resistance value (Ω) of the developer having a toner concentration of 2 mass % in a state formed into a magnetic brush, at an applied voltage of $10^4$ V/cm, and R2 is the resistance value (Ω) of the developer having a toner concentration of 12 mass % in a state formed into a magnetic brush, at an applied voltage of $10^4$ V/cm.

BRIEF DESCRIPTION OF THE DRAWINGS

An exemplary embodiments of the present invention will be described in detail based on the following figures, wherein.

DETAILED DESCRIPTION

Figure 1:
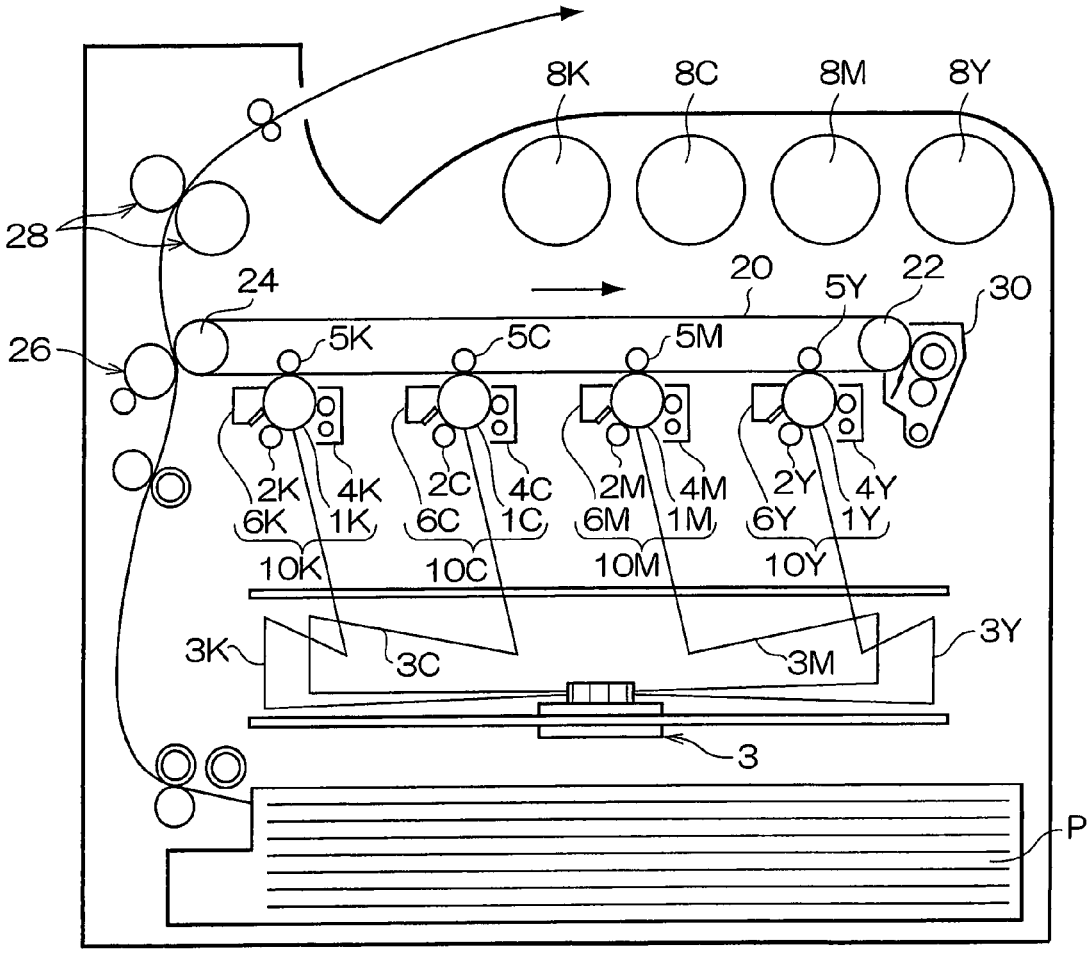
FIG. 1 is a schematic diagram showing an example of the image forming apparatus relating to the embodiments.

Hereinafter, the invention is described in detail.

<Electrostatic Image Developer>

The electrostatic image developer of the invention (hereinafter referred to sometimes as the "developer") contains a toner and a carrier having a resin coating layer formed on the surface of a core material containing a ferrite component, and having a ratio R1/R2 is from about 0.88 to about 0.92 where R1 is the resistance value (Ω) of the developer having a toner concentration of 2 mass % in a state formed into a magnetic brush, at an applied voltage of $10^4$ V/cm, and R2 is the resistance value (Ω) of the developer having a toner concentration of 12 mass % in a state formed into a magnetic brush, at an applied voltage of $10^4$ V/cm.

For stabilizing, against environmental change, the development characteristics and image quality of a developer when used in an actual machine, it is desirable to minimize the change in the charging property of a toner against change in toner concentration as described above, and consequently, the change in the resistance of the developer upon change in toner concentration should be reduced. However, the volume resistivity of the toner is generally higher than that of the carrier so that generally the resistance of the developer fluctuates with change in toner concentration, thus making stabilization of the resistance difficult.

As a result of examination, the inventors found, although the detailed mechanism is not evident, that the fluctuation in the resistance of a developer upon change in toner concentration may be reduced by using a special carrier regulating both resistivity distribution in and on a core material and the exposure ratio of a core material having a resin coating layer formed thereon.

Specifically, in a stage of main calcination for manufacturing a core material, the concentration of oxygen in a calcining atmosphere is made relatively high thereby regulating resistance so as to make volume resistivity higher than that of the final core material, and then the surface of the core material is subjected to reduction treatment in a hydrogen atmosphere thereby reducing the resistance value of the surface of the core material, whereby the core material as a whole is finished as a core material having desired volume resistivity.

In formation of a resin coating layer, a necessary amount of resin is calculated for example from the BET specific surface area of the core material. In addition, the concavity and convexity of the surface of the core material are regulated thereby regulating the exposure ratio of the core material, to allow the exposure ratio of the core material to be in a predetermined range.

The carrier obtained in this manner, as compared with conventional carriers, has characteristics such as hard breakdown in higher electric field and less change in resistance irrespective of the exposure ratio of the core material, and as described above, this carrier may be used to minimize the change in the resistance value of the developer even upon change in toner concentration, although its mechanism is not evident.

Specifically, in the electrostatic image developer of the invention, a ratio R1/R2 is from about 0.88 to about 0.92 where R1 is the resistance value (Ω) of the developer having a toner concentration of 2 mass % in a state of being formed into a magnetic brush, at an applied voltage of $10^4$ V/cm, and R2 is the resistance value (Ω) of the developer having a toner concentration of 12 mass % in a state of being formed into a magnetic brush, at an applied voltage of $10^4$ V/cm.

When a ratio R1/R2 is in the range described above, photoreceptor pollution, image pollution, image quality deterioration and image defects, which are caused by toner fogging and carrier scattering in an external environment or under machine conditions, hardly occur and stable images may be obtained.

That is, when the external environment is under high temperature and high humidity, the toner concentration should be decreased in order to maintain a constant image density. This is because the toner is hardly charged under high temperature and high humidity and the charging level is easily decreased with time, and thus the toner concentration should be decreased in order to keep the charging level of the toner high. At this time, the toner concentration is so low that the carrier easily scatters. Further, the image density may be made instable with fluctuation in toner concentration, and when the charging level becomes too low, image pollution is generated due to toner fogging.

Under low temperature and low humidity, on the other hand, the toner concentration should be increased in order to maintain a constant image density. This is because the toner is easily charged under low temperature and low humidity and the charging level is easily increased with time, and thus the toner concentration should be increased in order to keep the charging level of the toner low. At this time, the toner concentration is high and the charging level is high, and thus image density is not stabilized in some cases. Further, the resistance of the developer is increased to cause charge injection from the toner to the carrier, which may result in mixing the carrier in an image, thus leading to image defects. However, when R1/R2 ratio is in the above range, the change in the resistance of the developer upon change in toner concentration may be reduced, which may function against the problems described above.

For allowing a ratio R1/R2 to be higher than about 0.92, it is required in actuality to decrease the resistance of the toner or to increase the resistance of the carrier, and when the resistance of the toner is decreased, image defects such as fogging occur, while when the resistance of the carrier is increased, there occurs problems such as inferior reproducibility of thin line, thus failing to attain stable images. When a ratio R1/R2 is lower than about 0.88, the resistance value of the developer is not suitable relative to low toner concentration or high toner concentration, and at low toner concentration, carrier scattering easily occurs, while at high toner concentration, toner fogging easily occurs.

A ratio R1/R2 is desirably from about 0.88 to about 0.92, more desirably from about 0.89 to about 0.91.

The resistance of the developer R in a state of being formed into a magnetic brush can be determined in the following manner.

A specific image forming apparatus (or an image forming unit) is deprived of a photoreceptor and loaded with an aluminum pipe of the same size in place of the photoreceptor. In a development sleeve, a magnetic brush is then formed from the developer. Then, DC voltage is applied to the development sleeve so as to allow the field intensity to be at predetermined level.

The applied electric field is established as a value determined by dividing the applied DC voltage by the distance between the aluminum pipe and its opposed development sleeve; in the invention, the DC voltage is applied such that the field intensity becomes $10^4$ V/cm, and the current passing upon this voltage application is measured. Then, the resistance value r is determined from the applied voltage and the current value, and the resistance value R of the developer in a state formed into a magnetic brush is determined according to the following formula (1):

$$R=(\text{resistance value } r\times(\text{development sleeve effective length}))/(\text{distance between aluminum pipe and its opposed development sleeve}) \quad (1)$$

In the measurement described above, A Color 630 Copier (manufactured by Fuji Xerox Co., Ltd.) is used as the image forming apparatus, and at the time of measurement, the weight per unit area of the developer as a magnetic brush on the development sleeve opposed to the aluminum was 550 g/$m^2$. The measurement was carried out in an environment at a temperature of 20° C. in 50% relative humidity.

Hereinafter, the electrostatic image developer of the invention is described in detail by reference to the exemplary embodiment as follows.

(Carrier)

The carrier in the exemplary embodiment is constituted by forming a resin coating layer on the surface of a core material containing a ferrite component.

-Core Material-

The core material in the exemplary embodiment contains a ferrite component. This ferrite, though being not particularly limited, is generally represented by the following formula (2):

$$(MO)_X(Fe_2O_3)_Y \quad (2)$$

wherein X and Y each represent molar ratio by mass, and satisfy the equation: X+Y =100.

In the exemplary embodiment, M in the formula (2), though being not particularly limited insofar as it is a metal, is preferably a combination of Li, Mg, Ca, Mn, Sr and Sn. On one hand, it is not preferable that M is Cu, Zn or Ni. One reason for this is that these elements, upon addition, allow resistance to be lowered to cause charge leak easily, and when used in the core material, tend to be hardly coated with resin and also tend to deteriorate environmental dependence. These elements are heavy metals, and possibly because they are heavy, stress given to the carrier is increased and can adversely affect durability. Another reason is that ferrites to which Mn element and Mg element were added are widely distributed from the viewpoint of safety.

The core material is formed by granulation and calcination, and in the exemplary embodiment, its starting material oxide is previously finely ground in pretreatment. The grinding method is not particularly limited, and the starting material can be ground according to known grinding methods, for example by using a mortar, a ball mill, a jet mill etc. Although the finally ground state in the pretreatment varies depending on the quality of the material, etc., the material is ground into particles preferably having an average diameter of 2 μm to 10 μm. When the average diameter is smaller than 2 μm, the desired particle diameter may not be attained, while when the average diameter is greater than 10 μm, the particle diameter may become too greater or the degree of circularity may be decreased.

A method for manufacturing the core material containing a ferrite component involves, for example, blending suitable amounts of the above-mentioned oxides, then grinding them with a wet ball mill or the like, mixing them, granulating and drying the mixture with a spray dryer or the like, and temporarily calcining the resulting granules with a rotary kiln or the like.

The temperature in temporary calcination is preferably set lower than conventional and varies depending on the material used, but is preferably from 500° C. to 1200° C., more preferably from 600° C. to 1000° C. When the calcination temperature is lower than 500° C., the magnetic force of the core material necessary as carrier may not be attained, while when the temperature is higher than 1200° C., disproportionation of the inner structure easily occurs with rapid crystal growth, to cause cracking easily.

Temporary calcination is conducted desirably once to thrice as necessary or conducted preferably stepwise. Accordingly, the time of calcination as a whole is preferably longer. Thereafter, the temporarily calcinated material is dispersed in water and ground with a wet ball mill or the like. The resulting slurry is granulated and dried with a spray drier or the like, then subjected to main calcination under the control of oxygen concentration for the purpose of regulating magnetic characteristics and resistance, and ground and classified so as to provide the core material with desired particle distribution.

In the exemplary embodiment, it is desired that the temporarily calcinated material is ground for a long time and further classified thereby narrowing the particle size distribution of the ground material, and then subjected to main calcination at a relatively low temperature of 900° C. to 1100° C. Grain boundary in one ferrite may thereby be decreased and made uniform to lower the crystal-face continuity, and thus the fluctuation in the resistance of the core material upon change in applied voltage may be reduced.

In the atmosphere for the main calcination, the concentration of oxygen is desirably regulated in a predetermined range. The oxygen concentration in this main calcination influences the oxidation state of the surface of the resulting ferrite core material and thus contributes greatly to the resistance value (volume resistivity) of the core material. As described above, the resistance value of the core material after the main calcination is set desirably higher, and thus the oxygen concentration is desirably set relatively higher. Although the preferable oxygen concentration varies depending on constituent metal elements, the oxygen concentration is generally desirably from about 0.1 vol % to about 10 vol %.

In the exemplary embodiment, the volume resistivity of the core material after the main calcination is desirably from about $1.0\times10^9$ Ωcm to about $1.0\times10^{15}$ Ωcm, more desirably from about $1.0\times10^9$ Ωcm to about $1.0\times10^{11}$ Ωcm.

In a method of measuring the volume resistivity, core materials as the measuring object are placed to a thickness of about 1 to 3 mm evenly on the surface of a jig provided with a circular electrode plate having an area of 20 $cm^2$, to form a core material layer. Another circular electrode plate having the same area of 20 $cm^2$ is placed thereon to sandwich the core material layer between the electrode plates. To eliminate air gaps between the core materials, 4 kg loading is applied onto the electrode plate arranged on the core material layer, followed by measuring the thickness (cm) of the core material layer. Both the upper and lower electrodes are connected to an electrometer and a high-voltage power supply. High voltage is applied to both the electrodes to generate a electric field at 6000 V/cm, and by reading the current (A) passing upon this voltage application, the volume resistivity (Ω·cm) of the core material is calculated. The calculating formula for the volume resistivity (Ω·cm) of the core material is as shown in the following equation (3):

$$\rho=E\times20/(I-I_0)/L \quad (3)$$

wherein ρ is the volume resistivity (Ω·cm) of a core material, E is applied voltage (V), I is current value (A), $I_0$ is current value (A) at an applied voltage of 0 V, and L is the thickness (cm) of a core material layer. The coefficient "20" represents the area ($cm^2$) of the electrode plate.

The method of measuring the voltage resistivity of the carrier as shown below is also in accordance with the foregoing.

In the exemplary embodiment, the core material after the main calcination is finally subjected to reduction treatment desirably by beating in a hydrogen atmosphere. By this reduction treatment, the resistance value of the surface side of the core material may be reduced and the volume resistivity of the core material may be adjusted to a desired value.

Specifically, it is desired that the heat treatment is carried out at 200 to 800° C. in a rotary electric furnace, a batch electric furnace or the like, in an atmosphere containing hydrogen at a concentration in the range of from about 1 vol % to about 2 vol %, the balance being nitrogen. The volume resistivity of the core material after the reduction treatment is desirably from about $1.0\times10^{7}$ Ωcm to about $1.0\times10^{12}$ Ωcm, more desirably from about $1.0\times10^{8}$ Ωcm to about $1.0\times10^{10}$ Ωcm, as determined under the conditions described above.

The volume-average particle diameter of the core material in the exemplary embodiment is preferably from about 10 μm to about 500 μm, more preferably from about 30 μm to about 150 μm, still more preferably from about 30 μm to about 100 μm. When the core material having a volume-average particle diameter of smaller than about 10 μm is used in an electrostatic image developer, the adhesion between the toner and the carrier may be increased and the amount of the toner to be developed may be decreased. On the other hand, when the volume-average particle diameter is greater than about 500 μm, the magnetic brush is made so rough that a fine image may be hardly formed. The volume-average particle diameter of the core material is a value determined by using a laser diffraction/scattering particle size distribution measuring instrument (LS Particle Size Analyzer: LS13 320, manufactured by Beckman Coulter). The measured particle sizes are divided into size ranges (channels), and the volume cumulative distribution is plotted from the smaller size, and the cumulative volume particle size at cumulative 50% is defined as volume-average particle diameter D50v.

The BET specific surface area of the core material used in the exemplary embodiment is preferably from about 0.14 $m^2/g$ to about 0.28 $m^2/g$, more preferably from about 0.15 $m^2/g$ to about 0.22 $m^2/g$.

When the specific surface area of the core material is in the range defined above, the contact face between the resin coating layer and the core material is increased, thus increasing the adhesion therebetween and preferably suppressing detachment of the resin coating layer from the core material. When the specific surface area is smaller than about 0.14 $m^2/g$, the contact face between the resin coating layer and the core particle is decreased, and the resin coating layer, when used for a long time, may be detached, resulting in white dots and fogging on image. When the specific surface area is greater than about 0.28 $m^2/g$, the contact face of the two becomes so great that the thickness of the resin coating layer fails to be uniform, and thus the charge of the toner is not uniform and an image may be uneven.

In the exemplary embodiment, the arithmetic average roughness Ra of the surface of the core material is preferably about 0.1 μm or more, more preferably about 0.2 μm or more. The average distance Sm between concavity and convexity of the surface of the core material is preferably about 2.0 μm or less, more preferably about 1.8 μm or less.

Specifically, the arithmetic average roughness Ra and the average distance Sm between concavity and convexity can be determined by observing the surfaces of 50 core materials at 3000-fold magnification under an ultradeep color 3-D shape measurement microscope (VK-9500, manufactured by Keyence Corporation).

-Resin Coating Layer-

The resin (matrix resin) used in the resin coating layer can be any known resins used as resin coating layer materials for carrier, and may be a blend of two or more resins. The resin constituting the resin coating layer can be divided roughly into a charging resin for charging a toner and a resin of low surface energy used for preventing a toner component from transferring to a carrier.

The resin for negatively charging a toner includes amino type resin such as urea-formaldehyde resin, melamine resin, benzoguanamine resin, urea resin, polyamide resin and epoxy resin, as well as polyvinyl type resin and polyvinylidene type resin, acrylic resin, polymethyl methacrylate resin, polystyrene resin such as styrene acrylic copolymer resin, polyacrylonitrile resin, polyvinyl acetate resin, polyvinyl alcohol resin, polyvinyl butyral resin, and cellulose type resin such as ethyl cellulose resin.

The resin for positively charging a toner includes polystyrene resin, halogenated olefin resin such as polyvinyl chloride resin, polyester resin such as polyethylene terephthalate resin and polybutylene terephthalate resin, and polycarbonate resin.

The resin of low surface energy used for preventing a toner component from transferring to a carrier includes polyethylene resin, polyvinyl fluoride resin, polyvinylidene fluoride resin, polytrifluoroethylene resin, polyhexafluoropropylene resin, a vinylidene fluoride/acrylic monomer copolymer, a vinylidene fluoride/vinyl fluoride copolymer, a fluoroterpolymer such as a tetrafluoroethylene/vinylidene fluoride/non-fluorine monomer terpolymer, and silicone resin.

The resin coating layer may contain resin particles for the purpose of charging regulation. As the resin constituting the resin particles, it is possible to use thermoplastic resin and thermosetting resin.

The thermoplastic resin includes, for example, polyolefin type resin such as polyethylene and polypropylene; polyvinyl type resin and polyvinylidene type resin such as polystyrene, acrylic resin, polyacrylonitrile, polyvinyl acetate, polyvinyl alcohol, polyvinyl butyral, polyvinyl chloride, polyvinyl carbazole, polyvinyl ether and polyvinyl ketone; a vinyl chloride-vinyl acetate copolymer; a styrene-acrylic acid copolymer; a straight silicone resin containing organosiloxane bonds or modified products thereof; fluorocarbon resin such as polytetrafluoroethylene, polyvinyl fluoride, polyvinylidene fluoride and polychlorotrifluoroethylene; polyester; and polycarbonate.

Examples of the thermosetting resin include phenol resin; amino resin such as urea-formaldehyde resin, melamine resin, benzoguanamine resin, urea resin and polyamide resin; and epoxy resin.

The volume-average particle diameter of the resin particles is preferably in the range of 0.1 μm to 2.0 μm. When the particle diameter is smaller than 0.1 μm, the resin particles are inferior in dispersibility, thus aggregating in the resin coating layer to destabilize the ratio of exposure of a core particle to the surface and to make maintenance of charging property difficult in some cases. Further, the strength of the resin coating layer is reduced in the interface of the aggregate, thus allowing the carrier to be easily cracked in some cases.

On the other hand, when the particle diameter of the resin particles is greater than 2.0 μm, the resin particles may be easily released from the resin coating layer, thus failing to exhibit a function of conferring charging property. Depending on the particle size, the strength of the resin coating layer may be lowered.

The resin particles are contained preferably in an amount of 1 vol % to 50 vol %, more preferably 1 vol % to 30 vol %, still more preferably 1 vol % to 20 vol %, in the resin coating layer. When the content of the resin particles in the resin coating layer is lower than 1 vol %, the effect of the resin particles may not be exhibited, while when the content is greater than 50 vol %, the resin particles may be easily released from the resin coating layer, thus failing to attain stable charging property.

Further, electroconductive powders may be dispersed and contained in the resin coating layer.

Examples of the electroconductive powders include, but are not limited to, metals such as gold, silver, and copper; carbon black; metal oxides such as titanium oxide, magnesium oxide, zinc oxide, aluminum oxide, calcium carbonate, aluminum borate, potassium titanium and calcium titanate powders; and fine powders having titanium oxide, zinc oxide, barium sulfate, aluminum borate or potassium titanate powders coated thereon with tin oxide, carbon black and metals. These materials may be used alone or as a mixture of two or more thereof Use of metal oxides as the electroconductive powder is preferable for further reducing the environmental dependence of charging property, among which titanium oxide is particularly preferable.

The volume-average particle diameter of the electroconductive powder is preferably 1 μm or less. When the volume-average particle diameter is greater than 1 μm, the regulation of dispersion of the powder in the resin coating layer may be made difficult and the regulation of electric resistance may be made difficult. The amount of the electroconductive powder added is preferably smaller than 20 vol % of the resin coating layer. When the electroconductive powder is added in an amount of 20 vol % or more, the regulation of dispersion of the powder in the resin coating layer may be made difficult and the regulation of electric resistance may be made difficult. The method of dispersing the electroconductive powder include methods of using a sand mill, a dynomill, a homomixer etc.

A typical method of forming the resin coating layer on the surface of the carrier core material is a method of using a solution for forming a resin coating layer (that is, a solution containing, in a solvent, optionally used electroconductive powders and electrification-regulating resin particles in addition to a matrix resin forming a resin coating layer). Specific examples include, for example, the immersion method in which the core material is immersed in the solution for forming a resin coating layer; the spray method in which the solution for forming a resin coating layer is sprayed onto the surface of the core material; the fluidized bed method in which the solution for forming a resin coating layer is sprayed onto the core material floating with fluidizing air; and the kneader coater method in which the core material is mixed with the solution for forming a resin coating layer in a kneader coater and then the solvent is removed. The method is not particularly limited to those methods of using the solution, and for example, the powder coating method wherein the core material and resin powder are heated and mixed together may be suitably used depending on the type of core material used in preparing the carrier.

The solvent used in the resin coating layer-forming solution to form a resin coating layer is not particularly limited insofar as the matrix resin is dissolved therein, and examples of usable solvents include aromatic hydrocarbons such as xylene and toluene; ketones such as acetone and methyl ethyl ketone; and ethers such as tetrahydrofuran and dioxane; and halides such as chloroform and carbon tetrachloride.

A resin dispersion using water, alcohol etc. may also be used. In this case, a dispersion using a surfactant may deteriorate charging property due to the surfactant remaining after formation into a carrier, and thus the surfactant should be sufficiently removed. The method of removing a surfactant include a method wherein after coating with the resin, a surfactant is removed under stirring in deionized water at a temperature higher by 5 to 15° C. than the glass transition temperature (Tg) of the resin.

The total amount of the resin coating layer coated on the surface of the core material is preferably from about 1.0 mass % to about 5.0 mass %, more preferably from about 1.5 mass % to about 3 mass %. When the total amount of the resin coating layer is greater than about 5.0 mass %, the coating resin may be detached with time from the carrier to cause inconveniences, while when the total amount is lower than about 1.0 mass %, the amount of the resin component covering the surface of the core is inadequate thus failing to maintain resistance against applied voltage in some cases.

The average thickness of the resin coating layer is preferably from about 0.1 μm to about 10 μm, more preferably from about 0.1 μm to about 3.0 μm, still more preferably from about 0.1 μm to about 1.0 μm. When the average thickness of the resin coating layer is less than about 0.1 μm, resistance may be decreased due to cracking of the coating layer during use for a long time, or it may be made difficult to sufficiently regulate crushing of the carrier, while when the average thickness is more than about 10 μm, it sometimes takes longer time to attain saturated charging.

In the exemplary embodiment, the exposure ratio of the core material in the carrier having a resin coating layer formed as described above is desirably from about 2% to about 14%, more preferably from about 4% to about 8%. When the exposure ratio of the core material is in this range, a developer with less change in resistance against change in toner concentration may be obtained by combination with the ferrite core material, and photoreceptor pollution, image pollution, image quality deterioration, and image defects, which are caused by toner fogging and carrier scattering in an external environment or under machine conditions, hardly occur and stable images may be obtained.

Although detailed grounds are not evident, there are cases where when the exposure ratio of the core material is greater than about 14%, the contribution of the resin coating layer becomes lower, and image defects occur due to insufficient charging, while when the exposure ratio of the core material is lower than about 2%, the contribution of the core material may not be sufficiently obtained, and the resistance of the developer is substantially changed with change in toner concentration.

To allow the exposure ratio of the core material to be in the preferable range, it is desired not only to regulate the amount and thickness of the resin coating layer, but also to use the core material having suitable concavity and convexity as described above.

The ratio of exposure of the core material to the surface of the carrier is determined by (Fe atomic % of the carrier)/(Fe atomic % of the canier core material), wherein Fe atomic % can be calculated by measurement with the following measuring instrument under the conditions shown below.

Measuring instrument: JPS-9000MX manufactured by JEOL Ltd.

Conditions (measurement intensity): 10.0 kV, 20 mV

Source: MgKa

Analysis area: 10 mm×10 mm

Fe atomic %: The percentage of iron atoms in all elements having atomic numbers of 3 or more is determined.

For calculation of the surface atomic density, a relative sensitivity factor provided by JASCO Corporation is used. A peak intensity of each element measured is proportional to the amount of its atoms present in the analysis area. From the ratio of a peak intensity attributable to iron atoms on the surface of the carrier to peak intensities of non-iron atoms on the surface of the carrier, the ratio of exposure of the core material to the surface of the carrier is estimated.

Measurement of the ratio of exposure of the core material to the surface of the carrier in the developer is carried out in the following manner: First, the developer is placed in a container such as a beaker, then an aqueous solution of a surfactant (for example, 0.2 mass % aqueous solution of polyoxyethylenoctyl phenyl ether) is added thereto, and the carrier is held with a magnet below the container, while the toner only is washed away. This operation is repeatedly carried out until the supernatant turns colorless and transparent, and a suitable amount of ethanol is added to remove a surfactant adhering to the surface of the carrier. The carrier from which the toner was removed is dried in a drying oven. Thereafter, the ratio of exposure of the core material to the surface of the carrier can be measured.

In the Examples described later, the ratio of exposure of the core material to the surface of the carrier is measured by using the measuring instrument and conditions described above.

In the exemplary embodiment, the volume resistivity of the carrier as determined by the measurement method described above is regulated preferably in the range of from about $1\times10^{7}$ Ωcm to about $1\times10^{15}$ Ωcm, more preferably from about $1\times10^{8}$ Ωcm to about $1\times10^{14}$ Ωcm.

When the volume resistivity of the carrier is higher than about $1\times10^{15}$ Ωcm, the carrier has high resistance and hardly functions as a development electrode during development, thus exhibiting the edge effect particularly in a solid image, to deteriorate the reproducibility of solid image in some cases. On the other hand, the volume resistivity is lower than about $1\times10^{7}$ Ωcm, the carrier has low resistance, so there easily occurs inconvenience wherein when the concentration of the toner in the developer is decreased, charge is injected from a development roll to the carrier, to allow the carrier itself to be developed.

The degree of circularity of the carrier in the exemplary embodiment is preferably 0.970 or more, more preferably 0.974 or more. When the degree of circularity is lower than 0.970, breakage of the carrier may start at its distorted portion. The degree of circularity is determined by dispersing 0.03 g of the carrier in 25 mass % aqueous solution of ethylene glycol, measuring the dispersion with FPIA3000 (manufactured by Sysmex Corporation) as a measuring instrument in an LPF measurement mode, and analyzing the dispersion by cutting those particles having particle diameters of smaller than 10 μm and greater than 50 μm.

The saturation magnetization of the carrier is preferably at least about 40 emu/g, more preferably at least about 50 emu/g.

A vibrating sample type magnetic measuring instrument VSMP10-15 (manufactured by Toei Kogyo Co., Ltd.) is used as an instrument for measuring magnetic characteristics. The measurement sample is filled in a cell having an inner diameter of 7 mm and a height of 5 mm and then set in the above instrument. In measurement, a magnetic field is applied and then swept to 1000 Oe at a maximum. Then, the magnetic field is decreased to prepare a hysteresis curve on a recording paper. From data in this hysteresis curve, saturation magnetization, residual magnetization, and retentive power were determined. In the exemplary embodiment, the saturation magnetization refers to magnetization measured in a magnetic field at 1000 Oe.

(Toner)

The electrostatic image developer of the invention is a two-component developer including a toner and the carrier described above. Hereinafter, the toner is described in detail in the exemplary embodiment.

The toner used in the exemplary embodiment, though being not particularly limited, contains at least a binder resin and a colorant.

The binder resin contained in the toner can be suitably selected from known binder resins usable in toner particles. Specific examples include, for example, homopolymers or copolymers of mono-olefins such as ethylene, propylene, butylene and isoprene, vinyl esters such as vinyl acetate, vinyl propionate, vinyl benzoate and vinyl butyrate, α-methylene aliphatic monocarboxylates such as methyl acrylate, phenyl acrylate, octyl acrylate, methyl methacrylate, ethyl methacrylate, butyl methacrylate, and dodecyl methacrylate, vinyl ethers such as vinyl methyl ether, vinyl ethyl ether, vinyl butyl ether, and vinyl ketones such as vinyl methyl ketone, vinyl hexyl ketone, and vinyl isopropenyl ketone.

Among those described above, particularly typical binder resins include, for example, polystyrene, a styrene-alkyl acrylate copolymer, a styrene-butadiene copolymer, a styrene-maleic anhydride copolymer, polystyrene, and polypropylene. Further examples include polyester, polyurethane, epoxy resin, silicone resin, polyamide, and modified rosin.

In the exemplary embodiment, the binder resin desirably contains a crystalline polyester resin and a noncrystalline polyester resin, from the viewpoint of low-temperature fixation.

As used herein, the term "crystalline polyester resin" refers to a resin indicating not stepwise change in an endothermic amount but a clear endothermic peak in differential scanning calorimetry (DSC). In contrast, the term "noncrystalline polyester resin" refers to a resin indicating stepwise change in an endothermic amount in DSC.

The crystalline polyester resin is obtained by polycondensation reaction of a polyvalent carboxylic acid with a polyhydric alcohol.

The polyvalent carboxylic acid can include, for example, saturated aliphatic dicarboxylic acids such as oxalic acid, succinic acid, adipic acid, sebacic acid, azelaic acid, decane diacid, undecane diacid and dodecane diacid; unsaturated aliphatic dicarboxylic acids such as fumaric acid and maleic acid; hydroxydicarboxylic acids such as malic acid; and aromatic dicarboxylic acids such as phthalic acid, terephthalic acid and isophthalic acid. From the viewpoint of exhibiting crystallinity, saturated aliphatic dicarboxylic acids are preferable. Particularly referable examples are adipic acid, pimelic acid, suberic acid, azelaic acid, sebacic acid, nonane diacid, decane diacid, undecane diacid and dodecane diacid, that is, a saturated aliphatic dicarboxylic acid having 6 to 12 methylene groups. These dicarboxylic acids are preferable because the dicarboxylic acids when formed into esters at a concentration in a range mentioned later are highly crystalline as the resin and easily exhibit crystalline reversibility with temperature change.

The polyhydric alcohol includes, for example, ethylene glycol, propylene glycol, cyclohexane diol, butane diol, hexane diol, octane diol, decane diol, nonane diol, and dodecane diol. For exhibiting crystallinity when formed into resin, the polyhydric alcohol is preferably a saturated aliphatic dialcohol. Particularly preferable examples include hexane diol, heptane diol, octane diol, nonane diol, decane diol, undecane diol and dodecane diol, that is, a saturated aliphatic dialcohol having 6 to 12 methylene groups. These diols are preferable because the diols when formed into esters at a concentration in a range mentioned later are also highly crystalline as the resin and easily exhibit crystalline reversibility with temperature.

The crystalline polyester resin in the exemplary embodiment is obtained by polycondensation of such dicarboxylic acid and dialcohol.

The process for producing the crystalline polyester is not particularly limited, and the crystalline polyester can be produced by a general polyester polymerization method in which an acid component is reacted with an alcohol component, and the resin is produced by selectively using, for example, a direct polycondensation method or a transesterification method, depending on kinds of monomers. A molar ratio (acid component/alcohol component) when an acid component is reacted with an alcohol component varies with reaction conditions or the like and can thus not be unconditionally determined, but usually the molar ratio is around 1/1.

It is preferable that the crystalline polyester resin can be produced at a polymerization temperature of 180° C. to 230° C., and if necessary, a reaction system is evacuated, and the reaction is performed while water and an alcohol produced during the condensation are removed. When a monomer is not dissolved or is not compatible at the reaction temperature, a high boiling temperature solvent is added as a solubilizer to dissolve the monomer. The polycondensation reaction is carried out while the solubilizer solvent is distilled off. When a monomer poor in compatibility is present in the copolymerization reaction, the monomer poor in compatibility and an acid or an alcohol to be polycondensed with the monomer is previously condensed, and thereafter, a condensate may be polycondensed with a main component.

Examples of a catalyst which can be used in producing the crystalline polyester resin include an alkali metal compound such as sodium and lithium, an alkali earth metal compound such as magnesium and calcium, a metal compound such as zinc, manganese, antimony, titanium, tin, zirconium and germanium, a phosphorous acid compound, a phosphoric acid compound and an amine compound, and specifically, the following compounds can be mentioned.

For example, mention can be made of compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenylphosphite, tris (2,4-di-t-butylphenyl) phosphite, ethyltriphenylphosphonium bromide, triethylamine and triphenylamine.

The melting temperature of the crystalline polyester resin obtained by polymerization as described above is preferably from about 55° C. to about 100° C., more preferably from about 60° C. to about 80° C. A melting temperature in this range is preferable for excellent low-temperature fixability.

The melting temperature can be measured in the following manner. A differential scanning calorimeter DSC-7 manufactured by Perkin Elmer is used; the melting temperatures of indium and zinc are utilized for temperature correction in a detector of the apparatus; and the fusion heat of indium is used for calorimetric correction of the detector. An aluminum pan is used for a sample, and an empty pan is set for a reference, and the temperature is risen from room temperature to 150° C. at a rising rate of 10° C./min., then fallen from 150° C. to −30° C. at a rate of 10° C./min., and risen again from −30° C. to 150° C. at a rate of 10° C./min., and the maximum endothermic peak temperature in second temperature rising is regarded as the melting temperature.

The weight-average molecular weight of the crystalline polyester resin is preferably from about 5000 to about 30000, more preferably from about 5000 to about 18000. A weight-average molecular weight in this range is preferable for excellent low-temperature fixability.

The weight-average molecular weight is determined by measuring THF (tetrahydrofuran)-soluble matter with HLC-8020 manufactured by Tosoh Corporation and using a molecular weight calibration curve previously prepared with monodisperse polystyrene standard samples. Specifically, TSK gel, Super HM-H columns (6.0 mm ID×15 cm×2) are used with THF (tetrahydrofuran) as an eluent. Measurement conditions are as follows: the sample concentration is 0.5%, the flow rate is 0.6 ml/min., the sample injection volume is 10 μl, and the measurement temperature is 40° C. A calibration curve is prepared from 10 samples, that is, A-500, F-1, F-10, F-80, F-380, A-2500, F-4, F-40, F-128 and F-700. In sample analysis, data are collected at 300-ms intervals.

In the exemplary embodiment, the ester concentration of the crystalline polyester resin is preferably from about 0.078 to about 0.111, more preferably from about 0.080 to about 0.100.

The crystalline polyester resin rapidly changes its viscosity with temperature, and is suitable for low-temperature fixability. However, there easily occur problems such as permeation thereof into paper and image deletion, which are attributable to extreme reduction in viscosity upon fixation. Further, a toner made from the resin is sometimes inferior in charging property because the volume resistivity is made easily low due to easy alignment of polar groups in the resin.

The noncrystalline polyester resin described later, on the other hand, is dull to exhibit viscosity change with temperature and may be inferior in low-temperature fixability. By combining the crystalline polyester resin with the noncrystalline polyester resin, the fixability of the toner may be improved. Simultaneously, the ester concentration of the crystalline polyester resin is regulated in the range described above thereby making toner resistance suitable, to enable the toner to be provided with excellent low-temperature fixability and charging property. By combining this toner with the above carrier, low-temperature fixation and image stability may be acquired.

When the ester concentration is lower than about 0.078, the ratio of the hydrocarbon group to the ester group becomes too high and low-temperature fixability may be deteriorated. When the ester concentration is higher than about 0.111, the resistance of the developer may be decreased and image density may be destabilized.

The ester concentration in the exemplary embodiment is defined by the ratio of the number of ester groups in the polymer to the number of carbon atoms constituting the polymer chain, and is expressed by the equation below.

The ester concentration in the exemplary embodiment is defined by the ratio of the number of ester groups in the polymer to the number of carbon atoms constituting the polymer chain, and the ester concentration of the crystalline polyester resin composed of the two types of monomers described above is expressed by the following formula (4):

$$M=2/(Cad+Cal+4) \quad (4)$$

wherein M represents an ester concentration, Cad represents the number of hydrocarbon groups in the dicarboxylic acid monomer, and Cal is the number of carbon atoms in the dialcohol monomer.

The noncrystalline polyester resin usable in the exemplary embodiment is synthesized for example from a polyvalent carboxylic acid and polyhydric alcohol including, but not limited to, the following compounds.

Examples of the polyvalent carboxylic acid include aromatic carboxylic acids such as terephthalic acid, isophthalic acid, phthalic acid anhydride, trimellitic acid anhydride, pyromellitic acid and naphthalenedicarboxylic acid; aliphatic carboxylic acids such as maleic acid anhydride, fumaric acid, succinic acid, alkenyl succinic acid anhydride and adipic acid; and alicyclic carboxylic acids such as cyclohexanedicarboxylic acid.

These polyvalent carboxylic acids can be used alone or as a mixture of two or more thereof. Among these polyvalent carboxylic acids, an aromatic carboxylic acid is preferably used. For securing excellent fixability, the noncrystalline resin preferably has a crosslinking structure or a branched structure, for which a trivalent or more carboxylic acid (e.g., trimellitic acid or an acid anhydride thereof) is used in combination with a dicarboxylic acid.

Examples of the polyhydric alcohol include aliphatic diols such as ethylene glycol, diethylene glycol, triethylene glycol, propylene glycol, butane diol, hexane diol, neopentyl glycol and glycerin; alicyclic diols such as cyclohexane diol, cyclohexane dimethanol and hydrogenated bisphenol A; and aromatic diols such as a bisphenol A/ethylene oxide adduct and a bisphenol A/propylene oxide adduct.

These polyhydric alcohols may be used alone or as a mixture of two or more thereof. Among these polyhydric alcohols, aromatic diols and alicyclic diols are preferable and aromatic diols are more preferable. For securing excellent fixability, the noncrystalline polyester resin preferably has a crosslinking structure or a branched structure, for which the diol may be used in combination with trihydric or more polyhydric alcohols (e.g., glycerin, trimethylolpropane and pentaerythritol).

A monocarboxylic acid and/or a monoalcohol may be further added to the polyester resin obtained by polycondensation of the polyvalent carboxylic acid with the polyhydric alcohol, whereby a hydroxyl group and/or a carboxyl group at the terminal of the polymer can be esterified to regulate the acid value of the polyester resin. Examples of the monocarboxylic acid include acetic acid, acetic acid anhydride, benzoic acid, trichloroacetic acid, trifluoroacetic acid and propionic acid anhydride, while examples of the monoalcohol include methanol, ethanol, propanol, octanol, 2-ethylhexanol, trifluoroethanol, trichloroethanol, hexafluoroisopropanol and phenol.

The process for producing the noncrystalline polyester resin is not particularly limited, and the same method as described for the crystalline polyester resin can be used.

The glass transition temperature of the noncrystalline polyester resin that can be used in the exemplary embodiment is preferably from about 52° C. to about 68° C., more preferably from about 55° C. to about 64° C. A glass transition temperature in these ranges is preferable for excellent toner heat characteristics and powder characteristics.

The weight-average molecular weight Mw of the noncrystalline polyester resin that can be used in the exemplary embodiment is preferably from about 5000 to about 50000, more preferably from about 8000 to about 30000.

When the binder resin contains the crystalline polyester resin and noncrystalline polyester resin in the exemplary embodiment, the mass ratio of the crystalline polyester resin A to the noncrystalline polyester resin B (A/B) is preferably from about 0.1 to about 0.5, more preferably from about 0.2 to about 0.35.

When the A/B ratio is greater than about 0.5, the environmental stability of charging may be deteriorated, while when the A/B ratio is less than about 0.1, fusion characteristics necessary for low-temperature fixation may not be attained.

A colorant contained in the toner is not particularly limited. For example, it is possible to use carbon black, aniline black, aniline blue, calcoyl blue, chrome yellow, ultramarine blue, DuPont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, C.I. Pigment Blue 15:3, etc.

The toner can contain release agents such as low-molecular-weight polypropylene, low-molecular-weight polyethylene, and wax. As the wax, it is possible to use paraffin wax and derivatives thereof, montan wax and derivatives thereof, microcrystalline wax and derivatives thereof, Fischer Tropsch wax and derivatives thereof, and polyolefin wax and derivatives thereof. The derivatives include oxides, polymers with vinyl monomers, and graft-modified products. In addition, an alcohol, fatty acid, vegetable wax, animal wax, mineral wax, ester wax and acid amide can also be used.

If necessary, a charge regulator can be added to the toner. A charge regulator when added to a color toner is preferably a colorless or light-colored charge regulator not influencing the color tone of the toner. The charge regulators used may be those known in the art, and are preferably azo type metal complexes, or salicylic acid or alkylsalicylic acid metal complexes or metal salts.

For improving transferability, fluidity, cleaning property and charging regulation, particularly for improving fluidity, external additives may be contained in the toner in the exemplary embodiment. The external additives refer to inorganic particles allowed to adhere to the surfaces of core particles of the above-mentioned toners.

The inorganic particles that can be used include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, $MgSO_4$, etc. Among these, silica particles and titania particles are particularly preferable for improving fluidity.

Preferably, the surfaces of inorganic particles serving as the external additive have previously been subjected to hydrophobizing treatment. This hydrophobizing treatment not only improves the fluidity of toner powder but is also effective in respect of the environmental dependence of charging and the resistance of carrier to pollution. The hydrophobizing treatment can be carried out for example by dipping inorganic fine particles in a hydrophobizing agent. The hydrophobizing agent includes, but is not limited to, a silane coupling agent, silicone oil, a titanate coupling agent, and an aluminum coupling agent. These hydrophobizing agents can be used alone or as a mixture of two or more thereof. Among these, a silane coupling agent is preferable.

The volume-average particle diameter of the toner is preferably from about 2 μm to about 12 μm, more preferably from about 3 μm to about 10 μm, still more preferably from about 4 μm to about 9 μm. When the volume-average particle diameter of the toner particles is smaller than about 2 μm, fluidity is so deteriorated that formation of a developer layer with a layer regulating member or the like may be made insufficient, and fogging or dirt may be generated on images. On the other hand, when the volume-average particle diameter is greater than about 12 μm, resolution may be lowered to fail to attain high-resolution images, or the charging per unit weight of the developer may be lowered to deteriorate layer formation and maintenance of a developer layer and to generate fogging and dirt on images in some cases.

In a method of measuring the volume-average particle diameter of toner particles, 0.5 to 50 mg of the measurement sample is added to 2 ml of 5 mass % aqueous solution of a surfactant as a dispersant, preferably sodium alkylbenzenesulfonate. The mixture is added to 100 to 150 ml of the electrolyte solution. The electrolyte solution in which the measurement sample was suspended is then dispersed with an ultrasonic homogenizer for about 1 minute, and then the particle size distribution of the particles having particle diameters in the range of 2.0 to 60 μm is determined by using Coulter Multisizer II (manufactured by Beckmann Coulter) with an aperture having a diameter of 100 μm. The number of particles to be measured shall be 50,000.

The measured particle sizes are divided into size ranges (channels), and the volume cumulative distribution is plotted from the smaller size, and the cumulative volume particle size at cumulative 50% is defined as D50v.

The process for producing the toner is not particularly limited, and a dry process such as a kneading milling method and a wet granulation process such as a melt suspension method, an emulsification aggregation method or a dissolution suspension method known in the art can be suitably used.

The mixing ratio (ratio by mass) of the toner to the carrier, in the developer in the exemplary embodiment, is preferably in the range of about 1:100 to 30:100 (toner: carrier), more preferably in the range of about 3:100 to 20:100.

<Image Forming Apparatus>

Now, the image forming apparatus of the invention using the developer described will be explained.

The image forming apparatus of the invention includes an image supporting member, a developing unit for developing an electrostatic image as a toner image formed on the image supporting member with a developer, a transfer unit for transferring the toner image formed on the image supporting member onto a transfer material, and a fixing unit for fixing the toner image transferred onto the transfer material, wherein the electrostatic image developer of the invention is used as the developer.

In the image forming apparatus, for example, the part containing the developing unit may be a cartridge structure (process cartridge) attachable to, and detachable from, the main body of the image forming apparatus, and the process cartridge includes at least a developer supporting member, and the process cartridge of the invention for holding the electrostatic image developer of the invention can be preferably used.

Hereinafter, the image forming apparatus of the invention is described in detail by reference to one example, but is not limited thereto. Principal parts shown in the figure are described, and description of other parts is omitted.

FIG. 1 is a schematic diagram showing a full-color image-forming apparatus in a 4-tandem system. The image forming apparatus shown in FIG. 1 is provided with first to fourth image forming units 10Y, 10M, 10C, and 10K (image forming unit) in an electrophotographic system outputting an image of each color of yellow (Y), magenta (M), cyan (C) and black (K) based on color-separated image data. These image forming units (hereinafter referred to simply as "units") 10Y, 10M, 10C, and 10K are horizontally arranged with a predetermined space therebetween. The units 10Y, 10M, 10C and 10K may be process cartridges attachable to, and detachable from, the main body of the image forming apparatus.

Over the respective units 10Y, 10M, 10C and 10K, an intermediate transfer belt 20 is arranged as an intermediate transfer material through the respective units. The intermediate transfer belt 20 is arranged by being wound around a driving roller 22 and support roller 24 in contact with the inner surface of the intermediate transfer belt 20, the rollers 22 and 24 being arranged to be apart from each other from the left to right, and runs in the direction of from the first unit 10Y to the fourth unit 10K. The support roller 24 is biased with a spring or the like (not shown) so as to be apart from the driving roller 22, and a predetermined tension is applied to the intermediate transfer belt 20 wound between the two rollers. The image-bearing side of the intermediate transfer belt 20 is provided with a intermediate transfer material cleaning apparatus 30 opposite to the driving roller 22.

Developing apparatus (developing unit) 4Y, 4M, 4C and 4K for the respective units 10Y, 10M, 10C and 10K can be supplied with 4-color (yellow, magenta, cyan, black) toners held in toner cartridges 8Y, 8M, 8C and 8K.

The first to fourth units 10Y, 10M, 10C and 10K have a constitution similar to one another so that only the first unit 10Y forming a yellow image, arranged upstream of the intermediate transfer belt, is described. A description of the second to fourth units 10M, 10C and 10K is omitted by assigning reference marks given magenta (M), cyan (C) and black (K) in place of yellow (Y) given to the equivalent part of the first unit 10Y.

The first unit 10Y has a photoreceptor 1Y acting as an image supporting member 1Y. The photoreceptor 1Y is provided therearound with a charging roller 2Y for charging the surface of the photoreceptor 1Y at a predetermined voltage, an exposure apparatus 3 for exposing the charged surface to a laser light 3Y based on color-separated image signals to form an electrostatic image, a development apparatus (development unit) 4Y for developing the electrostatic image by feeding a negatively charged toner to the electrostatic image, a primary transfer roller 5Y (primary transfer unit) for transferring the developed toner image onto the intermediate transfer belt 20, and a photoreceptor cleaning apparatus (cleaning unit) 6Y for removing a toner remaining on the surface of the photoreceptor 1Y after primary transfer.

The primary transfer roller 5Y is arranged in the inside of the intermediate transfer belt 20 and arranged in a position opposite to the photoreceptor 1Y. A bias power source (not shown) for applying primary transfer bias is connected to each of primary transfer rollers 5Y, 5M, 5C and 5K. Each bias power source can change the transfer bias applied to each primary transfer roller by a control part (not shown).

Hereinafter, the operation of forming a yellow image in the first unit 10Y is described. First, the surface of the photoreceptor 1Y is charged at a voltage of about −600 V to −800V with a charging roller 2Y prior to operation.

The photoreceptor 1Y is formed by laminating a photosensitive layer on an electroconductive (volume resistivity at 20° C.: $1\times10^{-6}$ Ωcm or less) substrate. This photosensitive layer is usually highly resistant (with approximately the same resistance as that of general resin), but upon irradiation with laser ray 3Y, changes the property of changing the specific resistance of the portion irradiated with the laser ray. According to image data for yellow sent from a control part (not shown), the layer ray 3Y is outputted via the exposure device 3 onto the surface of the charged photoreceptor 1Y. The photosensitive layer on the surface of the photoreceptor 1Y is irradiated with the laser ray 3Y, whereby an electrostatic image in a yellow print pattern is formed on the surface of the photoreceptor 1Y.

An electrostatic image is an image formed on the surface of the photoreceptor 1Y by charging; that is, this image is a negative latent image which is formed because the charge of the surface of the photoreceptor 1Y flows due to a reduction in the specific resistance of the irradiated portion of the photosensitive layer, while charge remains on the portion not irradiated with laser ray 3Y.

The electrostatic image thus formed on the photoreceptor 1Y is rotated to a predetermined development position with running of the photoreceptor 1Y. In this development position, the electrostatic image on the photoreceptor 1Y is formed into a visualized image (developed image) with the development apparatus 4Y.

For example, a yellow toner having a volume-average particle diameter of 7 μm, containing at least a yellow colorant, a crystalline resin and a noncrystalline resin, is accommodated in the development apparatus 4Y. The yellow toner is stirred in the inside of the development apparatus 4Y and thereby frictionally electrified and retained on a developer roll (developer supporting member) by having the same polarity (negative polarity) as that of electrification charge on the photoreceptor 1Y. Then, the surface of the photoreceptor 1Y passes through the development apparatus 4Y thereby allowing the yellow toner to adhere electrostatically to the electrically neutralized latent image portion on the surface of the photoreceptor 1Y, thus developing the latent image with the yellow toner. The photoreceptor 1Y having the yellow toner image formed thereon is subsequently delivered at a predetermined speed, and the toner image developed on the photoreceptor 1 is sent to a predetermined primary transfer position.

When the yellow toner image on the photoreceptor 1Y is sent to the primary transfer position, a predetermined primary transfer bias is applied to the primary transfer roller 5Y, and electrostatic force sent from the photoreceptor 1Y to the primary transfer roller 5Y is allowed to act on the toner image, and the toner image on the photoreceptor 1Y is transferred onto the intermediate transfer belt 20. The transfer bias to be applied has (+) polarity reverse to the polarity (−) of the toner, and for example, the first unit 10Y is regulated at about +10 μA by a control part (not shown).

On the other hand, the toner remaining on the photoreceptor 1Y is removed and recovered by a cleaning apparatus 6Y.

The primary transfer bias applied to primary transfer rollers 5M, 5C and 5K after second unit 10M is also controlled in the same manner as in the first unit.

The intermediate transfer belt 20 having the yellow toner image transferred thereon in the first unit 10Y is delivered through the second to fourth units 10M, 10C, and 10K in this order, whereby multiple toner images of colors are transferred.

The intermediate transfer belt 20 having multiple toner images of 4 colors transferred thereon through the first to fourth units reaches a secondary transfer part composed of the intermediate transfer belt 20, the support roller 24 in contact with the inner surface of the intermediate transfer belt 20, and a secondary transfer roller (secondary transfer unit) 26 arranged in the side of the image-retaining surface of the intermediate transfer belt 20. On one hand, a recording paper (image receiving material) P is fed via a feeding mechanism with predetermined timing into a gap between the secondary transfer roller 26 and the intermediate transfer belt 20 which are contacted with each other with pressure, and a predetermined secondary transfer bias is applied to the support roller 24. The transfer bias to be applied has the same (−) polarity as the polarity (−) of the toner, and electrostatic force sent from the intermediate transfer belt 20 to the recording paper P is allowed to act on the toner image, and the toner image on the intermediate transfer belt 20 is transferred onto the recording paper P. The secondary transfer bias is determined depending on resistance detected by a resistance detector (not shown) for detecting the resistance of the secondary transfer part and is voltage-controlled.

Thereafter, the recording paper P is sent to a fixing apparatus (fixing unit) 28 where the toner image is heated, and the toner image of layered colors is fused and fixed on the recording paper P. After fixation of the color image is finished, the recording paper P is delivered to a discharging part and a series of these color image-forming operations are finished.

The image forming apparatus illustrated above is constituted such that a toner image is transferred via the intermediate transfer belt 20 onto the recording paper P, but this constitution is not intended to be limitative and the image forming apparatus may be structured such that a toner image may be transferred from the photoreceptor directly onto the recording paper.

<Process Cartridge>

Figure 2:
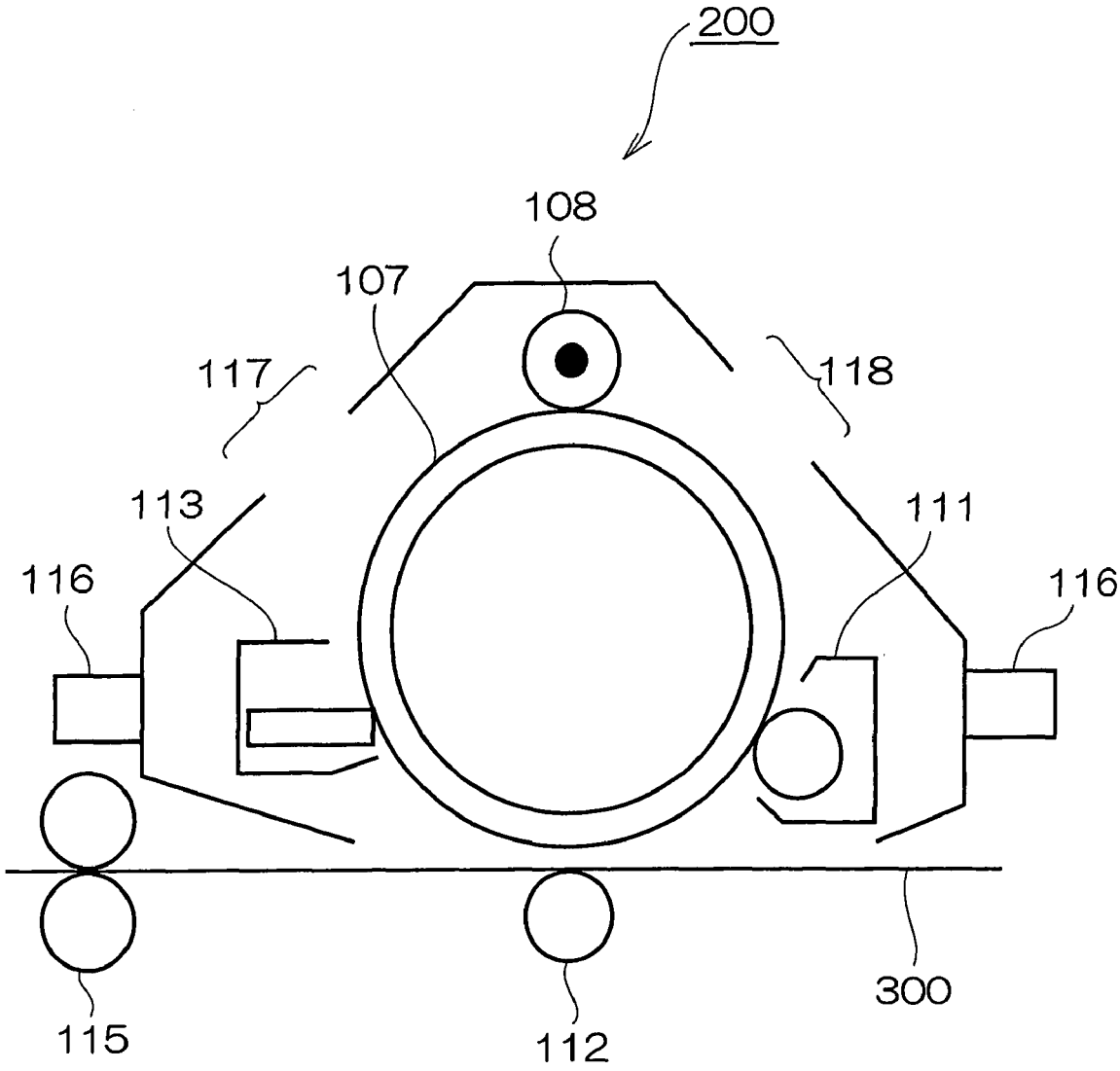
FIG. 2 is a schematic diagram showing an example of the process cartridge relating to the embodiments.

FIG. 2 is a schematic diagram showing one preferable example of the process cartridge for holding the electrostatic image developer of the invention. The process cartridge 200 includes a charging roller 108, a development apparatus 111, a photoreceptor cleaning apparatus (cleaning unit) 113, an opening 118 for light exposure, and an opening 117 for electricity removal and light exposure, which are combined with an attachment rail 116 and integrated with a photoreceptor 107.

Then, the process cartridge 200 is arbitrarily attachable to and detachable from the main body of the image forming apparatus constituted from the transfer apparatus 112, the fixing apparatus 115 and other component parts (not shown), and together with the main body of the image forming apparatus, constitutes the image forming apparatus. 300 is a recording paper.

The process cartridge shown in FIG. 2 is provided with the charging roller 108, the development apparatus 111, the cleaning apparatus (cleaning unit) 113, the opening 118 for light exposure, and the opening 117 for electricity removal and light exposure, and these devices can be arbitrarily combined. The process cartridge of the invention is provided with the photoreceptor 107 and at least one member selected from the group including the charging roller 108, the development apparatus 111, the cleaning apparatus (cleaning unit) 113, the opening 118 for light exposure, and the opening 117 for electricity removal and light exposure.

EXAMPLES

Hereinafter, the invention will be described in detail with reference to Examples, but it should be understood that the invention is not restricted thereby.

<Preparation of Ferrite Core Materials>

(Ferrite Core Material 1)

72 parts of $Fe_2O_3$, 20 parts by mass of $MnO_2$ and 8 parts by mass of $Mg(OH)_2$ are mixed, then mixed/ground for 25 hours with a wet ball mill, granulated and dried with a spray dryer, and then subjected to temporary calcination at 900° C. for 7 hours in a rotary kiln. The temporarily calcined product thus obtained is ground to 2.5 μm in average diameter with a wet ball mill for 24 hours and then sifted through a 16-μm sieve. The sifted material is granulated and dried with a spray dryer and then subjected to main calcination for 9 hours in an electric oven at a temperature of 1100° C. with oxygen at a concentration of 10 vol %.

The product is subjected to reduction treatment at 200° C. for 1 hour in a hydrogen atmosphere at a hydrogen concentration of 2 vol % and then subjected to oxidation treatment at 200° C. for 1.5 hours in a rotary furnace. Thereafter, the product is subjected to crushing and classification to prepare ferrite particle 1 with a particle diameter of 36 μm.

The volume resistivity of the prepared ferrite core material 1 upon voltage application of 6000 V/cm is $2.0\times10^8$ Ωcm.

(Ferrite Core Material 2)

73.5 parts by mass of $Fe_2O_3$, 18 parts by mass of $MnO_2$, 8 parts by mass of $Mg(OH)_2$ and 0.5 part by mass of SrO are mixed, then mixed/ground for 25 hours with a wet ball mill, granulated and dried with a spray dryer and then subjected to temporary calcination at 900° C. for 7 hours in a rotary kiln. The temporarily calcined product thus obtained is ground to 2.2 μm in average diameter with a wet ball mill for 30 hours and then sifted through a 16-μm sieve. The sifted material is granulated and dried with a spray dryer and then subjected to main calcination for 9 hours in an electric oven at a temperature of 1050° C. with oxygen at a concentration of 10 vol %.

The product is subjected to reduction treatment at 200° C. for 1 hour in a hydrogen atmosphere at a hydrogen concentration of 2 vol % and then subjected to oxidation treatment at 200° C. for 1.5 hours in a rotary furnace. Thereafter, the product is subjected to crushing and classification to prepare ferrite particle 2 with a particle diameter of 36 μm.

The volume resistivity of the prepared ferrite core material 2 upon voltage application of 6000 V/cm is $2.4\times10^{8}$ Ωcm.

(Ferrite Core Material 3)

70 parts of $Fe_2O_3$, 20 parts by mass of ZnO and 10 parts by mass of CuO are mixed, then mixed/ground for 25 hours with a wet ball mill, granulated and dried with a spray dryer and then subjected to temporary calcination at 1000° C. for 7 hours in a rotary kiln. The temporarily calcined product thus obtained is ground to 2.2 μm in average diameter with a wet ball mill for 24 hours and then sifted through a 16-μm sieve. The sifted material is granulated and dried (under the atmospheric condition) and then subjected to main calcination for 9 hours in an electric oven at a temperature of 1200° C. Thereafter, the product is subjected to crushing and classification to prepare ferrite particle 3 with a particle diameter of 37 μm.

Breakdown of the prepared ferrite core material 3 occurs upon voltage application of 6000 V/cm, thus making measurement of volume resistivity infeasible.

<Preparation of Coating Solution>

Styrene-acrylic resin (styrene/methyl methacrylate: 20 mol %/80 mol %): 50 parts by mass Carbon black (VXC72, manufactured by Cabot Corporation): 9 parts by mass Toluene (Wako Pure Chemical Industries, Ltd.): 531 parts by mass The above components and glass beads (particle diameter: 1 mm, the same amount as that of toluene) are introduced into a sand mill manufactured by Kansai Paint Co., Ltd., and then stirred at a revolving rate of 1200 rpm for 30 minutes to prepare a coating solution with a solid content of 10 mass %.

<Preparation of Carriers>

(Carrier 1)

A complex fluidized-bed coating unit MP01-SFP (manufactured by Powrex Corporation) is charged with 1000 parts of the ferrite core material 1, and the above coating solution is passed through a 0.5-mm screen mesh, stirred with a revolving impeller at 1000 rpm with a discharge gas of 1.2 $m^3$/min., and coated at a coating rate of 10 g/min. at a temperature of 65° C. for 24 minutes, onto the ferrite core material 1 to give carrier 1.

The amount of a coating on the carrier 1 is 2.4 mass %, and the exposure ratio of the core material as determined by the method described above is 10%. The volume resistivity thereof upon voltage application of 6000 V/cm is $1.0\times10^{10}$ Ωcm.

(Carrier 2)

Carrier 2 is obtained in the same manner as in preparation of carrier 1 except that the coating time is 30 minutes.

The amount of a coating on the carrier 2 is 3.0 mass %, and the exposure ratio of the core material as determined by the method described above is 4%. The volume resistivity thereof upon voltage application of 6000 V/cm is $5.0\times10^{10}$ Ωcm.

(Carrier 3)

Carrier 3 is obtained in the same manner as in preparation of carrier 1 except that the coating time is 45 minutes.

The amount of a coating on the carrier 3 is 4.0 mass %, and the exposure ratio of the core material as determined by the method described above is 0%. The volume resistivity thereof upon voltage application of 6000 V/cm is $1.0\times10^{11}$ Ωcm.

(Carrier 4)

Carrier 4 is obtained in the same manner as in preparation of carrier 1 except that the coating time is 18 minutes.

The amount of a coating on the carrier 4 is 1.8 mass %, and the exposure ratio of the core material as determined by the method described above is 14%. The volume resistivity thereof upon voltage application of 6000 V/cm is $1.0\times10^{9}$ Ωcm.

(Carrier 5)

Carrier 5 is obtained in the same manner as in preparation of carrier 1 except that the ferrite core material 2 is used in place of the ferrite core material 1, and the coating time is 32 minutes.

The amount of a coating on the carrier 5 is 3.0 mass %, and the exposure ratio of the core material as determined by the method described above is 6%. The volume resistivity thereof upon voltage application of 6000 V/cm is $1.0\times10^{10}$ Ωcm.

(Carrier 6)

Carrier 6 is obtained in the same manner as in preparation of carrier 1 except that the ferrite core material 2 is used in place of the ferrite core material 1, and the coating time is 16 minutes.

The amount of a coating on the carrier 6 is 1.6 mass %, and the exposure ratio of the core material as determined by the method described above is 20%. The volume resistivity thereof upon voltage application of 6000 V/cm is $1.0\times10^{8}$ Ωcm.

(Carrier 7)

Carrier 7 is obtained in the same manner as in preparation of carrier 1 except that the ferrite core material 3 is used in place of the ferrite core material 1, and the coating time is 24 minutes.

The amount of a coating on the carrier 7 is 2.3 mass %, and the exposure ratio of the core material as determined by the method described above is 10%. The volume resistivity thereof upon voltage application of 6000 V/cm is $1.0\times10^{8}$ Ωcm.

<Preparation of Toner>

(Preparation of Noncrystalline Polyester Resin Dispersion)

Ethylene glycol (manufactured by Wako Pure Chemical Industries, Ltd.): 37 parts by mass Neopentyl glycol (manufactured by Wako Pure Chemical Industries, Ltd.): 65 parts by mass 1,9-Nonanediol (manufactured by Wako Pure Chemical Industries, Ltd.): 32 parts by mass Terephthalic acid (manufactured by Wako Pure Chemical Industries, Ltd.): 96 parts by mass A flask is charged with the above-mentioned monomers and then heated over 1 hour to a temperature of 200° C., and after it is confirmed that the monomers in the reaction system are uniformly stirred, 1.2 parts by mass of dibutyltin oxide are introduced into the mixture. While water formed is distilled away, the temperature is increased over 6 hours to 240° C., and the dehydrogenation condensation reaction of the monomers is continued at 240° C. for additional 4 hours to yield a noncrystalline polyester resin having an acid value of 9.4 mg KOH/g, a weight-average molecular weight of 13,000 and a glass transition temperature of 62° C.

Then, this resin in a molten state is transferred to Cabitron CD 1010 (manufactured by Euroteck) at a rate of 100 parts by mass per minute. Dilute aqueous ammonia prepared by diluting reagent aqueous ammonia to a concentration of 0.37% by mass with deionized water is introduced into a separately prepared aqueous medium tank, and then transferred, under heating at 120° C. with a heat exchanger, to the above Cabitron at a rate of 0.1 L per minute, and simultaneously the above polyester resin in a molten state is transferred into it. The Cabitron is operated with a revolving rotator at 60 Hz at a pressure of 5 kg/cm$^2$ to give a noncrystalline polyester resin dispersion in which resin particles having an average particle diameter of 160 nm, a solid content of 30 mass %, a glass transition temperature of 62° C. and a weight-average molecular weight Mw of 13,000 were dispersed.

(Preparation of Crystalline Polyester Resin Dispersion)

-Crystalline Polyester Resin 1-

Dodecane diacid (manufactured by Tokyo Chemical Industry Co., Ltd.): 92 parts by mass Hexanediol (manufactured by Wako Pure Chemical Industries, Ltd.): 58 parts by mass A flask is charged with the above monomers and then heated over 1 hour to a temperature of 160° C., and after it is confirmed that the monomers in the reaction system are uniformly stirred, 0.03 part by mass of dibutyltin oxide is introduced into the mixture. While water formed is distilled away, the temperature is increased over 6 hours to 200° C., and the dehydrogenation condensation reaction of the monomers is continued at 200° C. for additional 4 hours and then terminated. The reaction mixture is cooled and then subjected to solid-liquid separation, and the resulting solids are dried at 40° C. in a vacuum to give a crystalline polyester resin 1.

The melting temperature of the resulting crystalline polyester resin 1, as determined by a differential scanning calorimeter DSC-7 manufactured by Perkin Elmer, is 70° C. The weight-average molecular weight of this polyester resin, as determined in tetrahydrofuran (THF) as solvent by a molecular-weight measuring instrument HLC-8020 manufactured by Tosoh Corporation, is 15000. The ester concentration of the crystalline polyester resin 1 is 0.09.

-Crystalline Polyester Resin 2-

Dodecane diacid (manufactured by Tokyo Chemical Industry Co., Ltd.): 81 parts by mass Hexanediol (manufactured by Wako Pure Chemical Industries, Ltd.): 47 parts by mass A flask is charged with the above monomers and then heated over 1 hour to a temperature of 160° C., and after it is confirmed that the monomers in the reaction system are uniformly stilled, 0.03 part by mass of dibutyltin oxide is introduced into the mixture. While water formed is distilled away, the temperature is increased over 6 hours to 200° C., and the dehydrogenation condensation reaction of the monomers is continued at 200° C. for additional 4 hours and then terminated. The reaction mixture is cooled and then subjected to solid-liquid separation, and the resulting solids are dried at 40° C. in a vacuum to give a crystalline polyester resin 2.

The melting temperature of the resulting crystalline polyester resin 2, as determined by a differential scanning calorimeter DSC-7 manufactured by Perkin Elmer, is 64° C. The weight-average molecular weight of this polyester resin, as determined in tetrahydrofuran (THF) as solvent by a molecular-weight measuring instrument HLC-8020 manufactured by Tosoh Corporation, is 15000. The ester concentration of the crystalline polyester resin 2 is 0.111.

-Crystalline Polyester Resin 3-

Dodecane diacid (manufactured by Tokyo Chemical Industry Co., Ltd.): 70 parts by mass Hexanediol (manufactured by Wako Pure Chemical Industries, Ltd.): 47 parts by mass A flask is charged with the above monomers and then heated over 1 hour to a temperature of 160° C., and after it is confirmed that the monomers in the reaction system are uniformly stilled, 0.03 part by mass of dibutyltin oxide is introduced into the mixture. While water formed is distilled away, the temperature is increased over 6 hours to 200° C., and the dehydrogenation condensation reaction of the monomers is continued at 200° C. for additional 4 hours and then terminated. The reaction mixture is cooled and then subjected to solid-liquid separation, and the resulting solids are dried at 40° C. in a vacuum to give a crystalline polyester resin 3.

The melting temperature of the resulting crystalline polyester resin 3, as determined by a differential scanning calorimeter DSC-7 manufactured by Perkin Elmer, is 56° C. The weight-average molecular weight of this polyester resin, as determined in tetrahydrofuran (THF) as solvent by a molecular-weight measuring instrument HLC-8020 manufactured by Tosoh Corporation, is 17000. The ester concentration of the crystalline polyester resin 3 is 0.125.

-Crystalline Polyester Resin 4-

Dodecane diacid (manufactured by Tokyo Chemical Industry Co., Ltd.): 92 parts by mass Dodecanediol (manufactured by Ube Industries, Ltd.): 81 parts by mass A flask is charged with the above monomers and then heated over 1 hour to a temperature of 160° C., and after it is confirmed that the monomers in the reaction system are uniformly stirred, 0.03 part by mass of dibutyltin oxide is introduced into the mixture. While water formed is distilled away, the temperature is increased over 6 hours to 190° C., and the dehydrogenation condensation reaction of the monomers is continued at 190° C. for additional 2 hours and then terminated. The reaction mixture is cooled and then subjected to solid-liquid separation, and the resulting solids are dried at 40° C. in a vacuum to give a crystalline polyester resin 4.

The melting temperature of the resulting crystalline polyester resin 4, as determined by a differential scanning calorimeter DSC-7 manufactured by Perkin Elmer, is 72° C. The weight-average molecular weight of this polyester resin, as determined in tetrahydrofuran (THF) as solvent by a molecular-weight measuring instrument HLC-8020 manufactured by Tosoh Corporation, is 4000. The ester concentration of the crystalline polyester resin 4 is 0.077.

Using the above crystalline polyester resins 1 to 4, crystalline polyester resin dispersions 1 to 4 are prepared in the following manner.

The crystalline polyester resin: 50 parts by mass

Anionic surfactant (trade name: Neogen SK, manufactured by Dai-ichi Kogyo Seiyaku Co., Ltd.): 2 parts by mass Deionized water: 200 parts by mass The above components are heated at 120° C., dispersed sufficiently with Ultra Turrax T50 manufactured by IKA Co., and subjected to dispersing treatment using a pressure discharge type homogenizer and recovered when the volume-average particle diameter becomes 180 nm. In this manner, each of crystalline polyester resin dispersions 1 to 4 having a solid content of 20% by mass is obtained.

(Preparation of Colorant Dispersion)

Cyan pigment (trade name: Pigment Blue 15:3, manufactured by Dainichiseika Colour & Chemicals Mfg. Co., Ltd.): 10 parts by mass Anionic surfactant (trade name: Neogen SC, manufactured by Dai-ichi Kogyo Seiyaku Co., Ltd.): 2 parts by mass Deionized water: 80 parts by mass The above components are mixed, then dispersed for 1 hour with a high-pressure impact type dispersing machine Altimizer (HJP30006, manufactured by Sugino Machine Limited) to give a colorant dispersion having a volume-average particle diameter of 180 nm and a solid content of 20% by mass.

(Preparation of Release Agent Dispersion)

Paraffin wax (trade name: HNP 9, manufactured by Nippon Seiro Co., Ltd.): 50 parts by mass Anionic surfactant (trade name: Neogen SC, manufactured by Dai-ichi Kogyo Seiyaku Co., Ltd.): 2 parts by mass Deionized water: 200 parts by mass The above components are heated to 120° C., mixed and dispersed sufficiently with Ultra Turrax T50 manufactured by IKA Co., and subjected to dispersing treatment using a pressure discharge type homogenizer to give a release agent dispersion having a volume-average particle diameter of 200 nm and a solid content of 20% by mass.

(Production of Toner)

-Toner 1-

Noncrystalline polyester resin dispersion: 150 parts by mass

Crystalline polyester resin dispersion 1:50 parts by mass

Colorant dispersion: 25 parts by mass

Polyaluminum chloride: 0.4 part by mass

Deionized water: 100 parts by mass

The above components are introduced into a stainless steel flask, then sufficiently mixed and dispersed with Ultra Turrax manufactured by IKA Co., and heated to 48° C. in the flask under stirring on a heating oil bath. After the mixture is kept at 48° C. for 60 minutes, 70 parts by mass of the same noncrystalline polyester resin dispersion as above are gently additionally added thereto.

Then, the pH in the system is adjusted to 8.0 with an aqueous solution of sodium hydroxide at a concentration of 0.5 mol/L, and then the stainless steel flask is sealed. While stirring is continued using a magnetic seal, it is heated up to 90° C. and kept for 3 hours. After the reaction, the reaction mixture is cooled at a falling temperature of 2° C./min., filtered, sufficiently washed with deionized water, and then subjected to solid-liquid separation by Nutsche suction filtration. The resulting solids are dispersed again in 3 L deionized water at 30° C., and stirred for 15 minutes at 300 rpm and washed. This washing operation is repeated further 6 times, and when the filtrate comes to have pH 7.54 and an electric conductivity of 6.5 μS/cm, solid-liquid separation is carried out by Nutsche suction filtration with paper filter No. 5A. Then, vacuum drying is continued for 12 hours to yield toner particles.

The volume-average particle diameter D50v of the toner particles as determined by a Coulter counter is 5.2 μm, and the volume-average particle size distribution indicator GSDv thereof is 1.20.

Silica ($SiO_2$) particles having an average primary particle diameter of 40 nm, whose surface is hydrophobized with hexamethyldisilazane (hereinafter abbreviated sometimes as "HMDS"), and metatitanic acid compound particles having an average primary particle diameter of 20 nm that are a reaction product of metatitanic acid and isobutyltrimethoxysilane, are added to the above toner particles such that the coverage of the toner particle surfaces therewith becomes 40%, followed by mixing them in a Henschel mixer to prepare toner 1.

-Toner 2-

Toner 2 is obtained in the same manner as in preparation of toner 1 except that in place of the crystalline polyester resin dispersion 1, the same parts of the crystalline polyester resin dispersion 2 are used.

The volume-average particle diameter D50v of the toner 2 as determined by a Coulter counter is 5.2 μm, and the volume-average particle size distribution indicator GSDv thereof is 1.21.

-Toner 3-

Toner 3 is obtained in the same manner as in preparation of toner 1 except that in place of the crystalline polyester resin dispersion 1, the same parts of the crystalline polyester resin dispersion 3 are used.

The volume-average particle diameter D50v of the toner 3 as determined by a Coulter counter is 5.2 μm, and the volume-average particle size distribution indicator GSDv thereof is 1.21.

-Toner 4-

Toner 4 is obtained in the same manner as in preparation of toner 1 except that in place of the crystalline polyester resin dispersion 1, the same parts of the crystalline polyester resin dispersion 4 are used.

The volume-average particle diameter D50v of the toner 4 as determined by a Coulter counter is 5.2 μm, and the volume-average particle size distribution indicator GSDv thereof is 1.21.

-Toner 5-

As toner 5, a cyan toner (free from the crystalline polyester resin) for Docu Center Color 400 (manufactured by Fuji Xerox Co., Ltd.) is used.

<Preparation of Developers, Developer Characteristics>

-Developer 1-

Carrier 1 and toner 1 are mixed to give developers having toner densities of 2 mass % and 12 mass %, respectively, and each of the developers is uniformly mixed by a V blender (developer 1). The R1/R2 ratio of these developers, as determined by measuring the resistance of each developer which is in a state formed into a magnetic brush by the method described above, is 0.90.

-Developer 2-

Carrier 1 and toner 2 are mixed to give developers having toner concentrations of 2 mass % and 12 mass %, respectively, and each of the developers is uniformly mixed by a V blender (developer 2). The R1/R2 ratio of these developers, as detennined by measuring the resistance of each developer which is in a state formed into a magnetic brush by the method described above, is 0.89.

-Developer 3-

Carrier 1 and toner 4 are mixed to give developers having toner concentrations of 2 mass % and 12 mass %, respectively, and each of the developers is uniformly mixed by a V blender (developer 3). The R1/R2 ratio of these developers, as determined by measuring the resistance of each developer which is in a state formed into a magnetic brush by the method described above, is 0.88.

-Developer 4-

Carrier 1 and toner 5 are mixed to give developers having toner concentrations of 2 mass % and 12 mass %, respectively, and each of the developers is uniformly mixed by a V blender (developer 4). The R1/R2 ratio of these developers, as determined by measuring the resistance of each developer which is in a state formed into a magnetic brush by the method described above, is 0.91.

-Developer 5-

Carrier 2 and toner 1 are mixed to give developers having toner concentrations of 2 mass % and 12 mass %, respectively, and each of the developers is uniformly mixed by a V blender (developer 5). The R1/R2 ratio of these developers, as determined by measuring the resistance of each developer which is in a state formed into a magnetic brush by the method described above, is 0.90.

-Developer 6-

Carrier 4 and toner 1 are mixed to give developers having toner concentrations of 2 mass % and 12 mass %, respectively, and each of the developers is uniformly mixed by a V blender (developer 6). The R1/R2 ratio of these developers, as determined by measuring the resistance of each developer which is in a state formed into a magnetic brush by the method described above, is 0.91.

-Developer 7-

Carrier 5 and toner 1 are mixed to give developers having toner concentrations of 2 mass % and 12 mass %, respectively, and each of the developers is uniformly mixed by a V blender (developer 7). The R1/R2 ratio of these developers, as determined by measuring the resistance of each developer which is in a state formed into a magnetic brush by the method described above, is 0.92.

-Developer 8-

Carrier 3 and toner 1 are mixed to give developers having toner concentrations of 2 mass % and 12 mass %, respectively, and each of the developers is uniformly mixed by a V blender (developer 8). The R1/R2 ratio of these developers, as determined by measuring the resistance of each developer which is in a state formed into a magnetic brush by the method described above, is 0.95.

-Developer 9-

Carrier 3 and toner 3 are mixed to give developers having toner concentrations of 2 mass % and 12 mass %, respectively, and each of the developers is uniformly mixed by a V blender (developer 9). The R1/R2 ratio of these developers, as determined by measuring the resistance of each developer which is in a state formed into a magnetic brush by the method described above, is 0.94.

-Developer 10-

Carrier 3 and toner 4 are mixed to give developers having toner concentrations of 2 mass % and 12 mass %, respectively, and each of the developers is uniformly mixed by a V blender (developer 10). The R1/R2 ratio of these developers, as determined by measuring the resistance of each developer which is in a state formed into a magnetic brush by the method described above, is 0.95.

-Developer 11-

Carrier 3 and toner 5 are mixed to give developers having toner concentrations of 2 mass % and 12 mass %, respectively, and each of the developers is uniformly mixed by a V blender (developer 11). The R1/R2 of these developers, as determined by measuring the resistance of each developer which is in a state formed into a magnetic brush by the method described above, is 0.96.

-Developer 12-

Carrier 6 and toner 1 are mixed to give developers having toner concentrations of 2 mass % and 12 mass %, respectively, and each of the developers is uniformly mixed by a V blender (developer 12). The R1/R2 ratio of these developers, as determined by measuring the resistance of each developer which is in a state formed into a magnetic brush by the method described above, is 0.10.

-Developer 13-

Carrier 1 and toner 3 are mixed to give developers having toner concentrations of 2 mass % and 12 mass %, respectively, and each of the developers is uniformly mixed by a V blender (developer 13). The R1/R2 ratio of these developers, as determined by measuring the resistance of each developer which is in a state formed into a magnetic brush by the method described above, is 0.88.

-Developer 14-

Carrier 7 and toner 1 are mixed to give developers having toner concentrations of 2 mass % and 12 mass %, respectively, and each of the developers is uniformly mixed by a V blender (developer 14). The R1/R2 ratio of these developers, as determined by measuring the resistance of each developer which is in a state formed into a magnetic brush by the method described above, is 0.52.

EXAMPLE 1

A developing device in Docu Centre Color 400 (manufactured by Fuji Xerox Co., Ltd.) is charged with the developer 1 having the toner at a concentration of 8 mass %, and the toner concentration is regulated in an environment at 10° C. in 20% RH (low-temperature low-humidity environment) such that the amount of the toner in a solid image becomes 0.6 g/m$^2$. At this time, the toner concentration is 3.2 mass %. Then, images with 100% and 50% image signal densities (Cin) with a size of 5 cm×10 cm are printed on 100 sheets. The temperature of a fixing device is 150° C.

Separately, the same test is carried out in an atmosphere at 32° C. in 88% RH (high-temperature high-humidity environment). At this time, the toner concentration is 9.5 mass %.

The printed matter is examined for image density and image defects (unevenness, density uniformity, white spots, bleeding, offset, etc.). The image density is measured with a reflection densitometer X-Rite 404 manufactured by X-Rite Co. The image defects are evaluated from the results of the items of evaluation, excluding white spots, under the following criteria:

A: Not problematic in all the evaluation items.

B: Problematic in one of the evaluation items.

C: Problematic in two of the evaluation items.

D: Problematic in three or more of the evaluation items.

(D is given where white spots occur.)

The results are collectively shown in Table 1.

EXAMPLE 2

The developer is evaluated in the same manner as in Example 1 except that the developer 2 is used in place of the developer 1.

The evaluation results are shown collectively in Table 1.

EXAMPLE 3

The developer is evaluated in the same manner as in Example 1 except that the developer 3 is used in place of the developer 1.

The evaluation results are shown collectively in Table 1.

EXAMPLE 4

The developer is evaluated in the same manner as in Example 1 except that the developer 4 is used in place of the developer 1.

The evaluation results are shown collectively in Table 1.

EXAMPLE 5

The developer is evaluated in the same manner as in Example 1 except that the developer 5 is used in place of the developer 1.

The evaluation results are shown collectively in Table 1.

EXAMPLE 6

The developer is evaluated in the same manner as in Example 1 except that the developer 6 is used in place of the developer 1.

The evaluation results are shown collectively in Table 1.

EXAMPLE 7

The developer is evaluated in the same manner as in Example 1 except that the developer 7 is used in place of the developer 1.

The evaluation results are shown collectively in Table 1.

EXAMPLE 8

The developer is evaluated in the same manner as in Example 1 except that the developer 13 is used in place of the developer 1.

The evaluation results are shown collectively in Table 1.

COMPARATIVE EXAMPLE 1

The developer is evaluated in the same manner as in Example 1 except that the developer 8 is used in place of the developer 1.

The evaluation results are shown collectively in Table 1.

COMPARATIVE EXAMPLE 2

The developer is evaluated in the same manner as in Example 1 except that the developer 9 is used in place of the developer 1.

The evaluation results are shown collectively in Table 1.

COMPARATIVE EXAMPLE 3

The developer is evaluated in the same manner as in Example 1 except that the developer 10 is used in place of the developer 1.

The evaluation results are shown collectively in Table 1.

COMPARATIVE EXAMPLE 4

The developer is evaluated in the same manner as in Example 1 except that the developer 11 is used in place of the developer 1.

The evaluation results are shown collectively in Table 1.

COMPARATIVE EXAMPLE 5

The developer is evaluated in the same manner as in Example 1 except that the developer 12 is used in place of the developer 1.

The evaluation results are shown collectively in Table 1.

COMPARATIVE EXAMPLE 6

The developer is evaluated in the same manner as in Example 1 except that the developer 14 is used in place of the developer 1.

The evaluation results are shown collectively in Table 1.

Table 1 shows that in the Examples, there are no particular problems in both image density and image defects, and white spots are not generated, even if the toner concentration is changed in the low-temperature and low-humidity environment and the high-temperature and high-humidity environment. In the Comparative Examples, on the other hand, there occur problems in some of the evaluation items, and white spots are generated.

The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

TABLE 1

| | | Image Density | | Image Defects | |
|---|---|---|---|---|---|
| | Developer | Low-temperature low-humidity environment | High-temperature high-humidity environment | Low-temperature low-humidity environment | High-temperature high-humidity environment |
| Example 1 | 1 | A | A | A | A |
| Example 2 | 2 | A | A | A | A |
| Example 3 | 3 | B (unevenness in image) | B (unevenness in image) | A | A |

TABLE 1-continued

| | | Image Density | | Image Defects | |
|---|---|---|---|---|---|
| | Developer | Low-temperature low-humidity environment | High-temperature high-humidity environment | Low-temperature low-humidity environment | High-temperature high-humidity environment |
| Example 4 | 4 | A | A | B (slight offset | B (slight offset) |
| Example 5 | 5 | A | A | A | A |
| Example 6 | 6 | A | A | A | A |
| Example 7 | 7 | A | A | A | A |
| Example 8 | 13 | A | B (unevenness in image) | A | A |
| Comparative Example 1 | 8 | C (varying density) | C (varying density) | A | A |
| Comparative Example 2 | 9 | C (varying density) | D (varying density) | A | A |
| Comparative Example 3 | 10 | C (varying density) | D (varying density) | B (slight offset) | B (slight offset) |
| Comparative Example 4 | 11 | C (varying density) | D (varying density) | B (slight offset) | B (slight offset) |
| Comparative Example 5 | 12 | C (varying density) | C (varying density) | D (white spots on image) | D (white spots on image) |
| Comparative Example 6 | 14 | C (varying density) | C (varying density) | D (white spots on image) | D (white spots on image) |

What is claimed is:

1. An electrostatic image developer comprising:

a toner; and a carrier having a resin coating layer formed on the surface of a core material containing a ferrite component, wherein the developer has a ratio R1/R2 of from about 0.88 to about 0.92 where:

R1 is the resistance value (Ω) of the developer having a toner concentration of 2 mass % when the developer is a magnetic brush, at an applied voltage of $10^4$ V/cm; and R2 is the resistance value (Ω) of a magnetic brush developer having a toner concentration of 12 mass % when the developer is a magnetic brush, at an applied voltage of $10^4$ V/cm, the exposure ratio of the core material in the carrier is from about 2% to about 14% and the BET specific surface area of the core material in the carrier is from about 0.14 $m^2/g$ to about 0.28 $m^2/g$.

2. The electrostatic image developer of claim 1, wherein the R1/R2 ratio is from about 0.89 to about 0.91.

3. The electrostatic image developer of claim 1, wherein the toner comprises a crystalline polyester resin and a noncrystalline polyester resin, and the ester concentration of the crystalline polyester resin is from about 0.078 to about 0.111.

4. The electrostatic image developer of claim 3, wherein the melting temperature of the crystalline polyester resin is from about 55° C. to about 100° C.

5. The electrostatic image developer of claim 3, wherein the weight-average molecular weight of the crystalline polyester resin is from about 5000 to about 30000.

6. The electrostatic image developer of claim 3, wherein the glass transition temperature of the noncrystalline polyester resin is from about 52° C. to about 68° C.

7. The electrostatic image developer of claim 3, wherein the weight-average molecular weight of the noncrystalline polyester resin is from about 5000 to about 50000.

8. The electrostatic image developer of claim 3, wherein the ratio of crystalline polyester resin mass A to noncrystalline polyester resin mass B (A/B) is from about 0.1 to about 0.5.

9. The electrostatic image developer of claim 1, wherein the volume-average particle diameter of the toner is from about 2 μm to about 12 μm.

10. The electrostatic image developer of claim 1, wherein the exposure ratio of the core material in the carrier is from about 4% to about 8%.

11. The electrostatic image developer of claim 1, wherein the core material of the carrier has been subjected to reduction treatment in a hydrogen atmosphere after main calcination.

12. The electrostatic image developer of claim 1, wherein the volume-average particle diameter of the core material in the carrier is from about 10 μm to about 500 μm.

13. The electrostatic image developer of claim 1, wherein the arithmetic average roughness Ra of the surface of the core material in the carrier is about 0.1 μm or more.

14. The electrostatic image developer of claim 1, wherein the total amount of the resin coating layer coated on the surface of the core material is from about 1.0 mass % to about 5.0 mass %.

15. The electrostatic image developer of claim 1, wherein the saturation magnetization of the carrier is about 40 emu/g or more.

16. The electrostatic image developer of claim 1, wherein the volume resistivity of the carrier is from about $1\times10^7$ Ωcm to about $1\times10^9$ Ωcm.

17. A process cartridge comprising at least a developer supporting member and accommodating an electrostatic image developer, the electrostatic latent image developer comprising;

a toner; and a carrier having a resin coating layer formed on a surface of a core material containing a ferrite component, wherein the developer has a ratio R1/R2 of from about 0.88 to about 0.92 where:

R1 is the resistance value (Ω) of the developer having a toner concentration of 2 mass % when the developer is a magnetic brush, at an applied voltage of $10^4$ V/cm; and R2 is the resistance value (Ω) of a magnetic brush developer having a toner concentration of 12 mass % when the developer is a magnetic brush, at an applied voltage of $10^4$ V/cm, the exposure ratio of the core material in the carrier is from about 2% to about 14%, and the BET specific surface area of the core material in the carrier is from about 0.14 $m^2/g$ to about 0.28 $m^2/g$.

18. An image forming apparatus comprising;

an image supporting member;

a developing unit that develops an electrostatic image, formed on the image supporting member, as a toner image with a developer;

a transfer unit that transfers the toner image formed on the image supporting member onto an image receiving material; and a fixing unit that fixes the toner image transferred onto the image receiving material, the developer having:

a toner; and a carrier having a resin coating layer formed on a surface of a core material containing a ferrite component, wherein the developer has a ratio R1/R2 of from about 0.88 to about 0.92 where:

R1 is the resistance value (Ω) of the developer having a toner concentration of 2 mass % when the developer is formed into a magnetic brush, at an applied voltage of $10^4$ V/cm; and R2 is the resistance value (Ω) of a magnetic brush developer having a toner concentration of 12 mass % when the developer is formed into a magnetic brush, at an applied voltage of $10^4$ V/cm, the exposure ratio of the core material in the carrier is from about 2% to about 14%, and the BET specific surface area of the core material in the carrier is from about 0.14 $m^2/g$ to about 0.28 $m^2/g$.

* * * * *